United States Patent [19]

Dutt et al.

[11] 4,123,022

[45] Oct. 31, 1978

[54] SEAM FOR FORMING WIRES AND DRYER FELTS

[75] Inventors: William H. Dutt, Rensselaer; Eric R. Romanski, Delmar, both of N.Y.

[73] Assignee: Albany International Corp., Albany, N.Y.

[21] Appl. No.: 832,609

[22] Filed: Sep. 12, 1977

[51] Int. Cl.[2] ..... B21F 15/06

[52] U.S. Cl. ..... 245/10; 139/383 A; 139/425 R

[58] Field of Search ..... 245/10, 3; 139/383 R, 139/383 A, 407, 425 R, 425 A; 140/24, 3 R; 24/140, 145; 198/848

[56] References Cited

U.S. PATENT DOCUMENTS 3,225,900 12/1965 MacBean et al. ..... 139/383 A

FOREIGN PATENT DOCUMENTS 613,817 12/1960 Italy ..... 139/425 R

*Primary Examiner*—Lowell A. Larson

*Attorney, Agent, or Firm*—Kane, Dalsimer, Kane, Sullivan and Kurucz

[57] ABSTRACT

The disclosure is of a seam construction for joining the ends of woven forming wire wet felts and dryer felt materials. The forming wires wet felts, and dryer felts are used on papermaking machines in the manufacture of paper, paperboard and the like. The seam comprises a plurality of metal and/or plastic eyepins, having body crimps adapted to permit interweaving of the pins with the crosswise yarns of the forming wire wet felt or dryer felt material ends. The pins are so interwoven and are spaced to interleaf with the pins of the opposite end. A seam pin is threaded through the eyes of the eyepins to join the ends of the forming wire, wet felt or dryer felt material together.

6 Claims, 8 Drawing Figures

SEAM FOR FORMING WIRES AND DRYER FELTS

BACKGROUND OF THE INVENTION

1. Field of the Invention

The invention relates to a seam construction for joining the ends of a belt, thereby making it endless, and more particularly relates to a seam construction for an endless forming wire press fabrics or dryer felt.

2. Brief Description of the Prior Art

The art is replete with descriptions of seam constructions for dryer felts and forming wires; see for example the disclosures of U.S. Pat. Nos. 1,065,991; 3,191,893; 3,478,991; and 3,436,041. In general, the seam constructions of the prior art have not been entirely satisfactory for all purposes and applications. This is particularly true of seam constructions for forming wires, press fabrics or felt and dryer felts fabricated from polymeric, non-metallic yarns. For example, one of the most common seams of the prior art is the so-called "clipper seam". Clipper hooks are pressed into the ends of the fabric to make the joinder of the ends. The clipper hooks are the same hooks employed in the belt industry to make leather belts endless. The problem with the clipper seam on forming wires and dryer felts is related to its bulk. The clipper seam is generally thicker than the body of the joined fabric. In addition, clipper seams are relatively weak seams.

The seam construction of the invention is substantially stronger than a clipper seam and has a low profile, i.e., produces a thinner seam.

SUMMARY OF THE INVENTION

The invention comprises a seam construction joining together the ends of a forming wire or a dryer felt, which comprises;

the ends to be joined;

a plurality of eyepins having sinuously curved bodies, replacing terminal portions of the lengthwise yarns in each of said ends, said eyepins being anchored in the ends by an interweaving of the sinuous bodies with the crosswise yarns in the ends, the curves of the sinuous body mating with the crimp of the weave of said crosswise yarns, the eyes of said eyepins projecting from each end wherein the eyepin is anchored, said eyepins being positioned in the ends so that when the ends are brought together, the eyes of one end interleaf with the eyes of the other end; and a joinder pin passing through the interleafed eyes of said eyepins whereby said ends are joined together.

DETAILED DESCRIPTION OF THE PREFERRED EMBODIMENTS OF THE INVENTION

Figure 1:
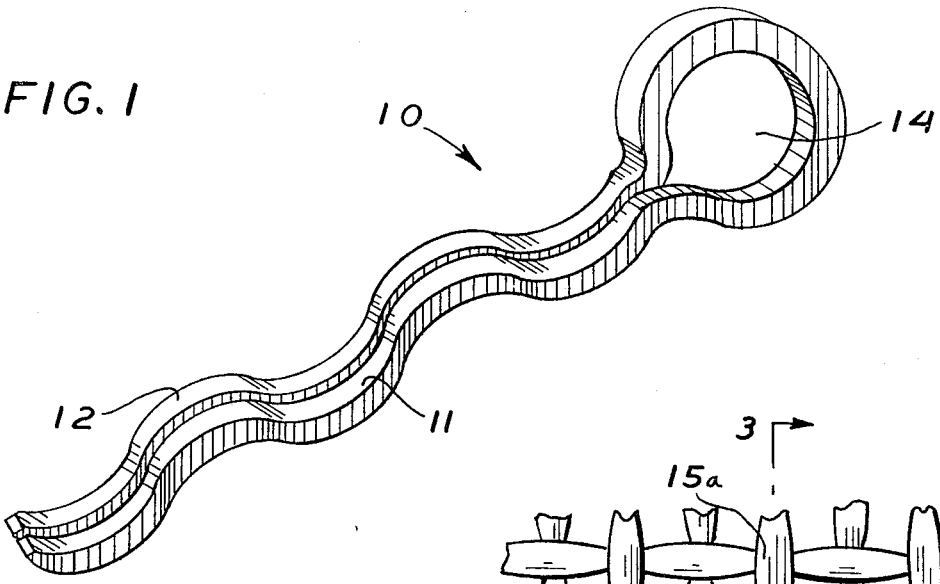
FIG. 1 is an isometric view of an embodiment eyepin component of the seam of the invention.

The preferred embodiments of the invention are best understood by reference to the accompanying drawings of FIGS. 1 through 7, inclusive. Referring first to FIG. 1, one may see an isometric view of an embodiment split eyepin 10 component of the seam of the invention. Eyepin 10 may be a preformed, corrugated, metal pin with a loop 14 at one end. The split body of pin 10 consists of parallel, sinuous shafts 11 and 12 which are joined together by the loop 14. The sinuously curved shafts 11 and 12 are adapted to match and mate with the crimped crosswise yarns in the fabric ends to be joined together, as will be discussed in greater detail hereinafter. The formation of the metal looped eyepin 10 is made using a metal die which has convolutions that match the crimp pattern of the desired looped eyepin. The crimp imparted to the metal pin in conjunction with the crimp of the woven fabric into which the looped eyepin is to be inserted provides anchoring or a high degree of holding power once the eyepins 10 are inserted in the ends of the fabric to be joined together by virtue of the matching crimps.

Figure 2:
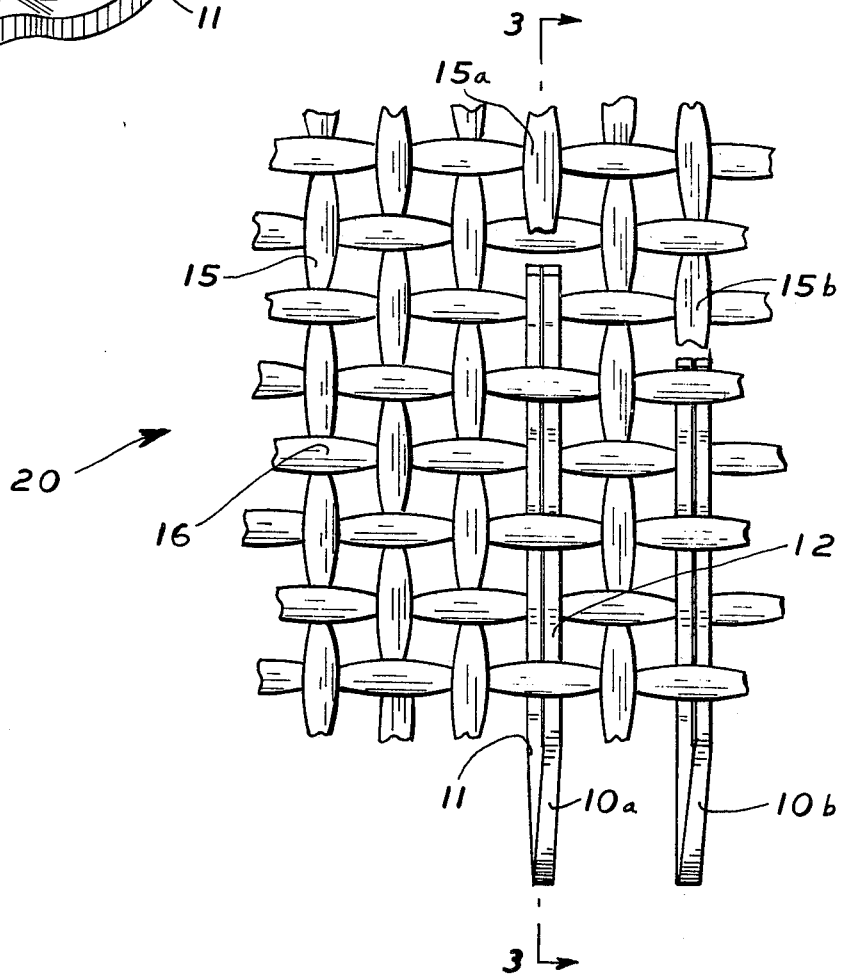
FIG. 2 is a top view of a portion of a fabric end including eyepins as shown in FIG. 1.

Referring now to FIG. 2, a top view of a portion of a fabric end 20, one may see how the eyepin 10 is interwoven with the weave of a simple woven fabric. The fabric constitutes a simple weave of crosswise yarns 16 with lengthwise yarns 15. A portion of lengthwise yarn 15*a* has been removed and the removed portion replaced by split eyepin 10*a*, interwoven so that the curves of the sinuous shafts 11 and 12 mate with the crimped crosswise yarns. Another portion of lengthwise yarn 15*b* has been removed and replaced by the split eyepin 10*b*. Split eyepins 10*a* and 10*b* differ from one another in length so as to distribute the crimped holding points between the woven yarns of the fabric body into which the looped eyepins are inserted. This provides for a stronger seam.

Figure 3:
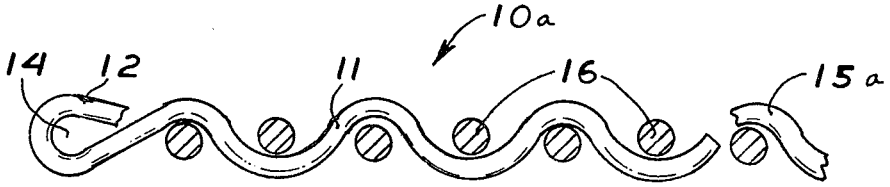
FIG. 3 is a cross-sectional view along lines 3—3 of FIG. 2.

Referring now to FIG. 3, a cross-sectional view along lines 3—3 of FIG. 2, one can see how the sinuously curved shafts 11 and 12 are interwoven with crosswise yarns 16.

Figure 4:
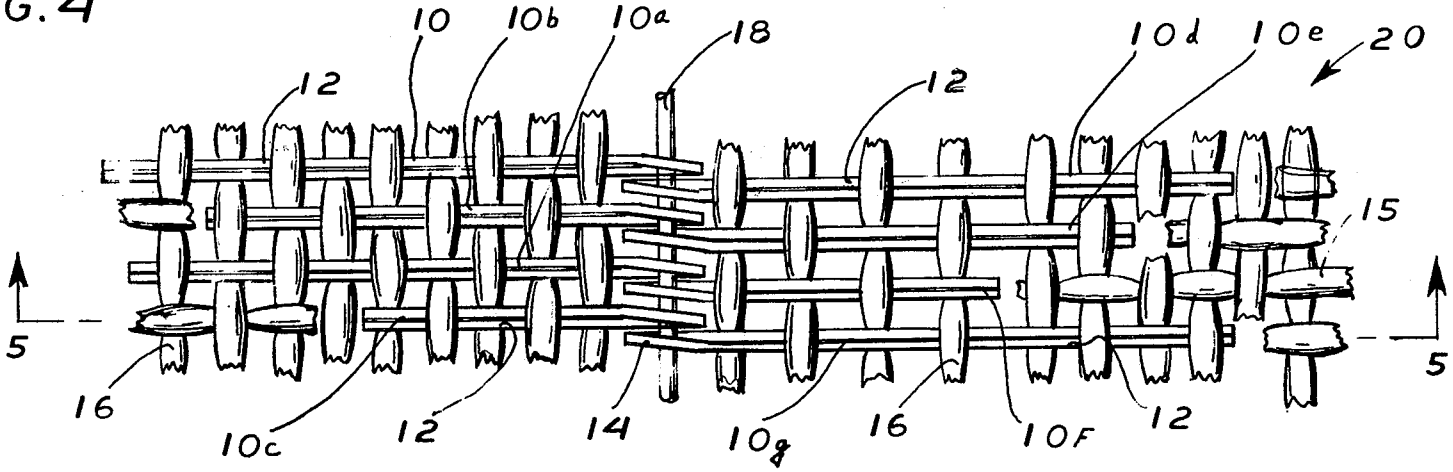
FIG. 4 is a top view of the end shown in FIG. 2 joined to another end.
Figure 5:
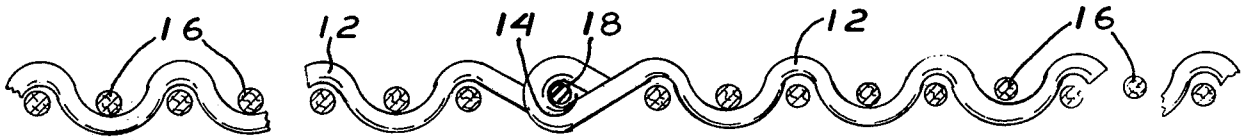
FIG. 5 is a cross-sectional view along lines 5—5 of FIG. 4.
Figure 6:
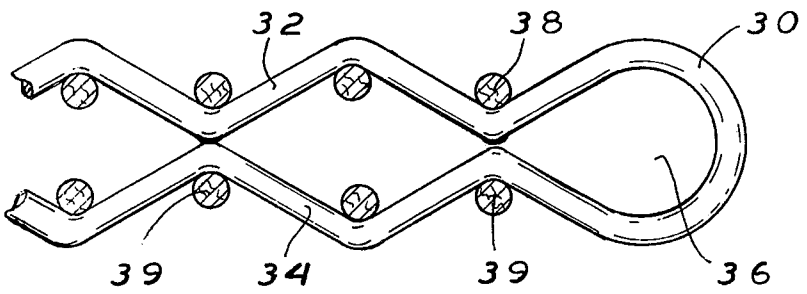
FIG. 6 and FIG. 7 are each side elevations of alternate embodiment split eyepin components for seams of the invention particularly adapted for joining the ends of two-layered woven fabrics.

Once the eyepins 10 have been inserted as previously described into the ends to be joined in a seam construction according to this invention, the ends may be joined as shown in FIG. 4. FIG. 4 is a top view of the end 20 shown in FIG. 2 joined to another end 21. As shown in FIG. 4, the eyepins 10 are positioned so that when the ends 20 and 21 are brought together, the eyes 14 of each eyepin 10 interleaf or intermesh with one another. A joining pin 18 may then be passed through the eyes 14 of each eyepin 10 to establish the connection between ends 20 and 21. In this manner, eyepins 10*a*, 10*b*, 10*c*, 10*d*, 10*e* and 10*f*, together with joiner pin 18, provide a very strong and stable seam construction. Further details of the seam construction of the invention may be observed by referring now to FIG. 5, a cross-sectional view along lines 5—5 of FIG. 4. It will be noted from the cross-sectional view of FIG. 5, that the seam has a thickness which is not greater than the thickness of the fabric ends 20 and 21. This is desirable and may be accomplished by the proper selection of the diameter of the loops or eyes 14.

Those skilled in the art will appreciate that many modifications may be made to the embodiments described above without departing from the spirit and the scope of the invention. For example, the pin may be fabricated from a high strength polymeric resin such as a nylon, polycarbonate and the like, or from braided or twisted metal which may or may not be treated or coated with a polymeric resin such as a polyamide resin and the like. Other shapes may also be used. For example, referring to FIG. 6, there is seen an eyepin 30 whose body shafts 32, 34 are curved in a manner adapting the eyepin 30 to mate with and be interwoven with a double layer woven fabric having upper crosswise yarns 38 and lower crosswise yarns 39. The body shafts 32, 34 of the eyepin 30 are joined together by eye 36.

Figure 7:
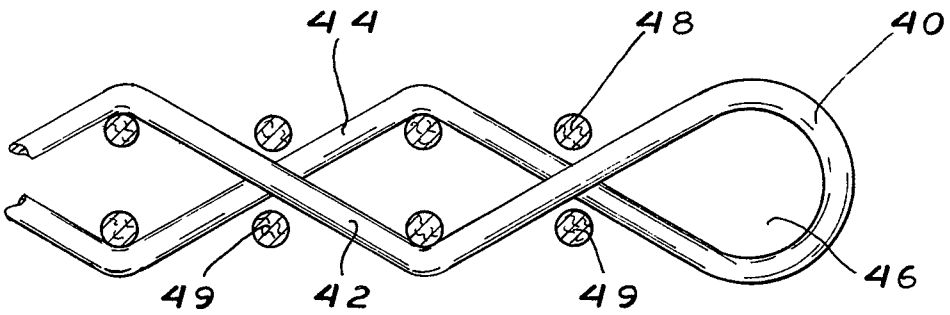

Referring now to FIG. 7, one can see a further alternate embodiment of an eyepin 40 adapted for use with a double layer woven fabric material wherein the body of eyepin 40 is curved in a manner adapted to enable the shafts 42 and 44 to traverse the thickness of the fabric weave and interweave with both upper and lower crosswise yarns 48, 49. The shafts 42, 44 are connected through eye 46. This last embodiment eyepin 40 is particularly preferred in double weave fabrics whose ends are to be joined because of the extra strength provided by traversal of the entire thickness of the woven fabric by the shafts 42, 44.

Figure 8:
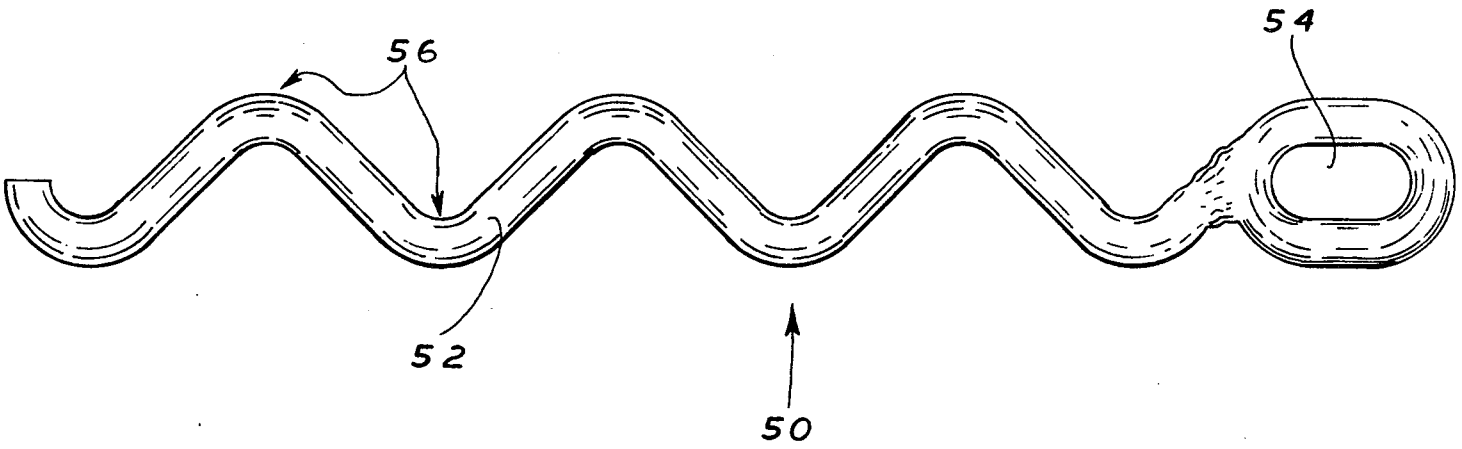
FIG. 8 is an isometric view of another embodiment eyepin of the invention.

FIG. 8 is an isometric view of an eyepin 50 preferably made from a high strength synthetic polymeric resin (plastic) of a grade that is injection moldable. Examples of this high strength resin are nylon, polyester, polycarbonates and the like. The technique used to make the eyepin 50 is to mold the plastic using injection mold equipment as known in the plastics industry. The plastic eyepin 50 comprises a convoluted stem 52 which, unlike the metal split eyepin 10, is a singular (not split) member having an eye 54 which is integrally formed with the stem 52. When the pin 50 is molded it is not convoluted or oriented, a secondary operation is performed after the pin 50 has been molded. The stem 52 is drawn to orient the structure and then concoluted using a heated metal die. Note that the eye 54 in the pin 50 is not round but oblong which is caused during the drawing process. This drawing process adds strength to the stem 52 by orienting the plastic material. The convolutions 56 and/or crimp imparted to the plastic stem 52 in conjunction with the crimp of the woven fabric into which the looped eyepin 50 is to be inserted provides anchoring or a high degree of holding power once the plastic eyepins 50 are inserted in the ends of the fabric to be joined together by virtue of the matching crimps.

We claim:

1. A seam construction joining together the ends of a forming wire press fabric or felt or a dryer felt, which comprises;

the ends to be joined;

a plurality of eyepins having sinuously curved bodies, replacing terminal portions of the lengthwise yarns in each of said ends, said eyepins being anchored in the ends by an interweaving of the sinuous bodies with the crosswise yarns in the ends, the curves of the sinuous body mating with the crimp of the weave of said crosswise yarns, the eyes of said eyepins projecting from each end wherein the eyepin is anchored, said eyepins being positioned in the ends so that when the ends are brought together, the eyes of one end interleaf with the eyes of the other end; and a joinder pin passing through the interleafed eyes of said eyepins whereby said ends are joined together.

2. The construction of claim 1 wherein said eyepins are metallic, split eyepins.

3. The construction of claim 1 wherein said eyepins have singular bodies of high strength synthetic polymer resin.

4. The construction of claim 3 wherein said resin is selected from the group consisting of nylon, polyester and polycarbonate.

5. The construction of claim 1 wherein said eyepins are braided or twisted metal strands.

6. The construction of claim 5 wherein said eyepins are coated with a polymeric resin.

* * * * *